US005446935A

United States Patent [19]

Beretta

[11] Patent Number: 5,446,935

[45] Date of Patent: Sep. 5, 1995

[54] METHOD OF REDUCING THE CONSUMPTION OF UREA IN THE PRINTING OF COTTON AND VISCOSE FABRICS

[76] Inventor: Mario Beretta, Via G.P. Clerici, 2, 21040 Gerenzano (Varese), Italy

[21] Appl. No.: 284,835

[22] Filed: Aug. 2, 1994

Related U.S. Application Data

[62] Division of Ser. No. 146,922, Nov. 3, 1993.

[30] Foreign Application Priority Data

Dec. 28, 1992 [IT] Italy ..... MI92A2977

[51] Int. Cl.[6] ..... D06B 3/12

[52] U.S. Cl. ..... 8/149.1; 8/149.3

[58] Field of Search ..... 8/149.1, 149.3; 68/5 D, 68/5 E

[56] References Cited

U.S. PATENT DOCUMENTS

| | | | |
|---|---|---|---|
| 2,443,990 | 6/1948 | O'Keeffe | 68/5 E |
| 3,805,560 | 4/1974 | Fleissner | 68/5 D |
| 3,894,410 | 7/1975 | Fleissner | 68/5 D |
| 3,942,695 | 3/1976 | Fleissner | 68/5 D X |
| 4,070,877 | 1/1978 | Fleissner | 68/5 D |
| 5,010,612 | 4/1991 | Jensen et al. | 8/149.1 |

FOREIGN PATENT DOCUMENTS

| | | | |
|---|---|---|---|
| 2656425 | 6/1978 | Germany | 68/5 D |
| 2716265 | 10/1978 | Germany | 68/5 D |
| 3333889 | 4/1985 | Germany | 8/149.3 |

*Primary Examiner*—Philip R. Coe
*Attorney, Agent, or Firm*—Bucknam and Archer

[57] ABSTRACT

A device for reducing the consumption of urea and/or hygroscopic chemical substances, in paste materials for printing cotton, viscose and the like fabrics, includes, upstream of a steaming chamber, a pre-moistening chamber, into which there is introduced saturated steam as well as, in a continuous manner, a printed fabric material. This printed fabric material is caused to pass, for at least a length thereof, through the pre-moistening chamber and, for at least a length thereof, through environment air, in order to be cooled, and then being immediately again introduced into the pre-moistening chamber.

2 Claims, 7 Drawing Sheets

METHOD OF REDUCING THE CONSUMPTION OF UREA IN THE PRINTING OF COTTON AND VISCOSE FABRICS

This is a Divisional of application Ser. No. 146,922, filed Nov. 3, 1993 pending.

BACKGROUND OF THE INVENTION

The present invention relates to a device and method for reducing the consumption of urea and/or hygroscopic chemical substances in paste materials for printing cotton and viscose fabrics.

In the fabric printing field there are already known several types of steaming chambers, into which the fabric, after having being printed, is introduced in order to set the printed pattern.

Prior steaming chambers, however, are affected by several drawbacks, the main of which is that they require that comparatively great amounts of urea be used, with a consequent great pollution of the used water.

Also known is the fact that cotton and viscose fabrics are conventionally printed by using reactive coloring materials or dyes.

In order to set, under a steam environment, these dyes, urea must be added to the printing paste material, with a proportion of about 150 g per Kg.

This urea is required in order to absorb water present in the processing steam, so as to cause the cellulose fibres to be swollen.

Moreover, urea facilitates the absorption of the dye material as well as its chemical reaction with the fibres to be dyed.

As urea is dissolved in the processing steam, an endothermic reaction will occur causing the printed fabric to be quickly cooled.

This reaction will cause further steam to condense, so as to enhance the moisture contents of the printed fabric, thereby promoting the above mentioned setting process.

To the foregoing it is to be moreover added that from urea ammonia is evolved which pollutes air to which steam is discharged or the water used in a fabric washing step following the steam setting step thereof.

In this connection it should be moreover pointed out that present anti-pollution rules are very restrictive and, accordingly, it would be advantageous to greatly reduce the use of urea in fabric printing paste materials.

Such an use, as it should be apparent, could be greatly reduced if the moisture contents of the fabric material were increased as this fabric is supplied to the steaming chamber.

In actual practice, in order to heat water up to its boiling point, it is necessary to use an amount of energy which corresponds to three times the energy amount required to bring to 100° C. the fabric.

This means that a greater amount of steam will tend to condense on a fabric having a higher moisture content, independently from the amount of urea which is present.

Attempts performed in order to increase the moisture rate of the printed fabric material provided for moistening the fabrics before steaming them.

Some prior systems provided for spraying atomized water directly on the printed fabric, supplied in a not set condition.

However, these systems did not provide satisfactory results and they can operate in a reliable way exclusively if they are controlled by sophisticated and expensive control systems, since water absorption by the fabric is very uneven with the danger of adding an excessive water amount to some regions of the fabric piece and a low water amount to other regions thereof.

SUMMARY OF THE INVENTION

Accordingly, the object of the present invention is to overcome the above mentioned drawbacks, by providing a method for reducing the urea and/or chemical substance consumption in the cotton, viscose and the like fabric printing paste material, affording the possibility of moistening, in a very even and constant manner, the fabric, before the steaming step, so as to bring the fabric to its natural moisture contents value, before the printing step or, preferably, so as to bring the fabric to higher moisture contents values.

Within the scope of the above mentioned object, a main object of the present invention is to provide such a process allowing to print fabric materials in a very satisfactory manner, owing to a very accurate metering of the processing steam.

Another object of the present invention is to provide such a process which can be easily applied to available fabric steaming chambers.

Yet an object of the present invention is to provide such a process which can be operated in a continuous manner, without modifying the conventional operation characteristics of available fabric printing systems and which, moreover, is such as to greatly reduce the pollution problems.

Yet another object of the present invention is to provide such a process which can be easily carried out starting from easily commercially available elements and materials and which, moreover, is very competitive from a mere economical standpoint.

According to one aspect of the present invention, this object is achieved by a process for reducing the consumption of urea and/or hygroscopic chemical substances in paste materials for printing cotton and viscose fabrics, which comprises the use, upstream of a steaming chamber, of a pre-moistening chamber into which there are introduced saturated steam and, in a continuous manner, a printed fabric material to be processed.

The fabric material is caused to pass, for at least a length thereof, through the pre-moistening chamber and, for at least a length thereof, through environment air, in order to cool it, and then being immediately introduced again into the steaming chamber.

BRIEF DESCRIPTION OF THE DRAWINGS

Further characteristics and advantages of the invention will become more apparent hereinafter from the following detailed description of a preferred, though not exclusive, embodiment of method for reducing the consumption of urea and/or hygroscopic chemical substances in paste materials for printing cotton and viscose fabrics, which is illustrated, by way of an indicative, but not limitative, example, in the accompanying drawings, where.

DESCRIPTION OF THE PREFERRED EMBODIMENTS

Figure 5:
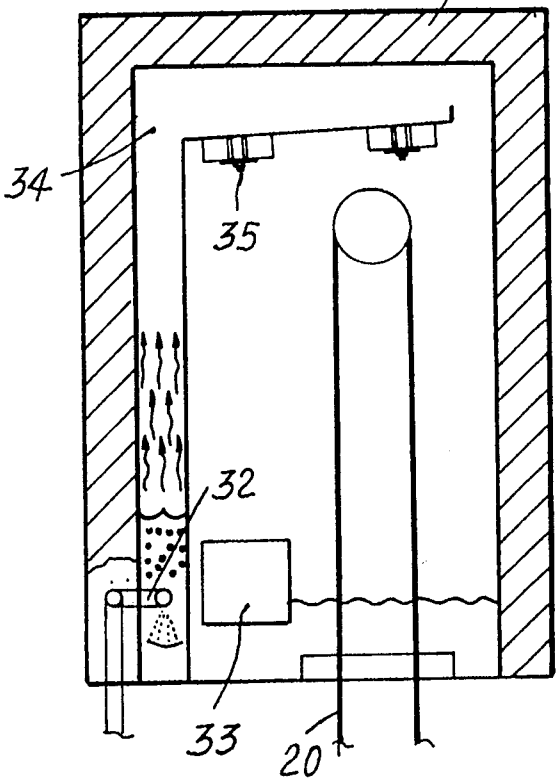
FIG. 5 illustrates a pre-moistening chamber, which can be used as an independent unit, in combination with prior steaming chambers.
Figure 1:
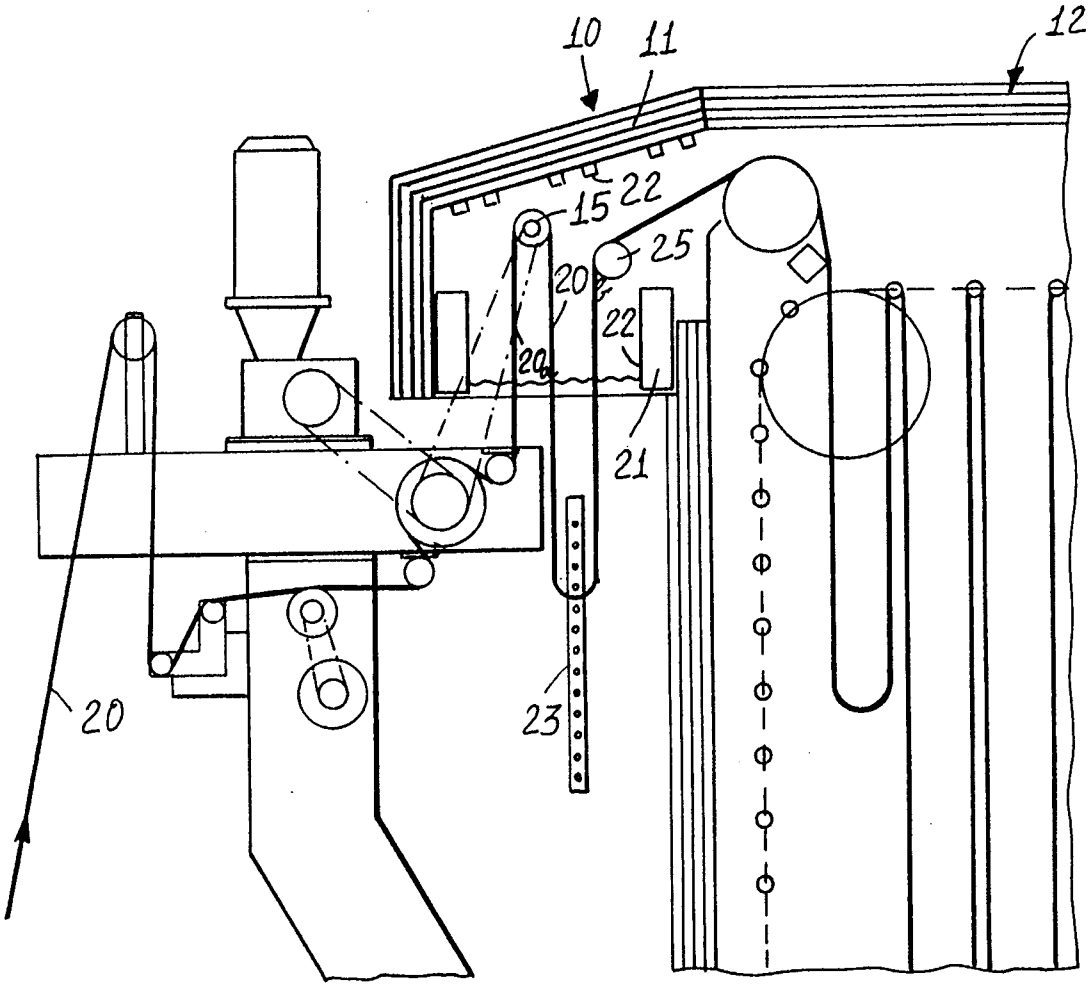
FIG. 1 illustrates a pre-moistening device which can be directly applied to a steaming chamber.
Figure 2:
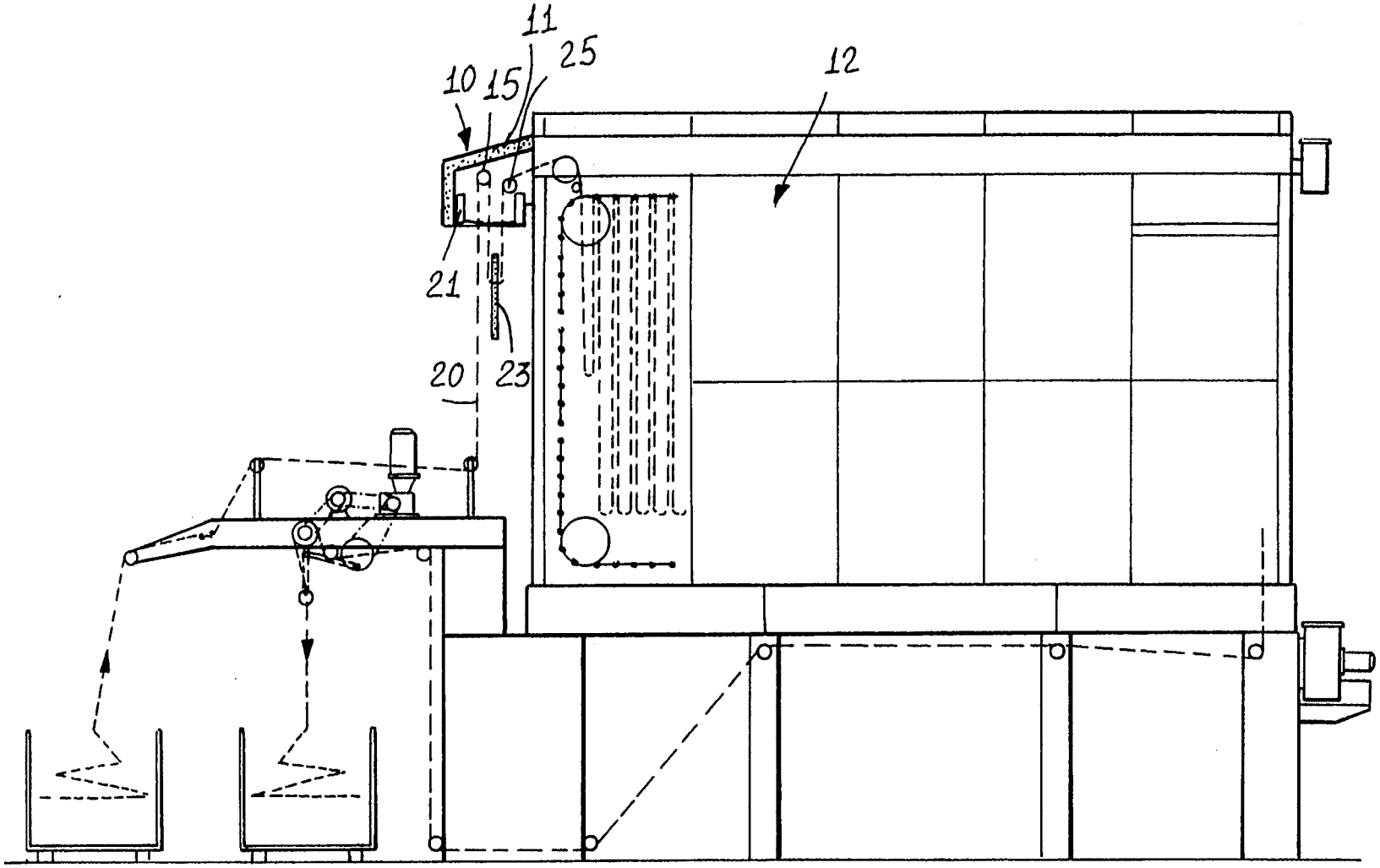
FIG. 2 illustrates the pre-moistening device applied to a steaming chamber having an open bottom.
Figure 3:
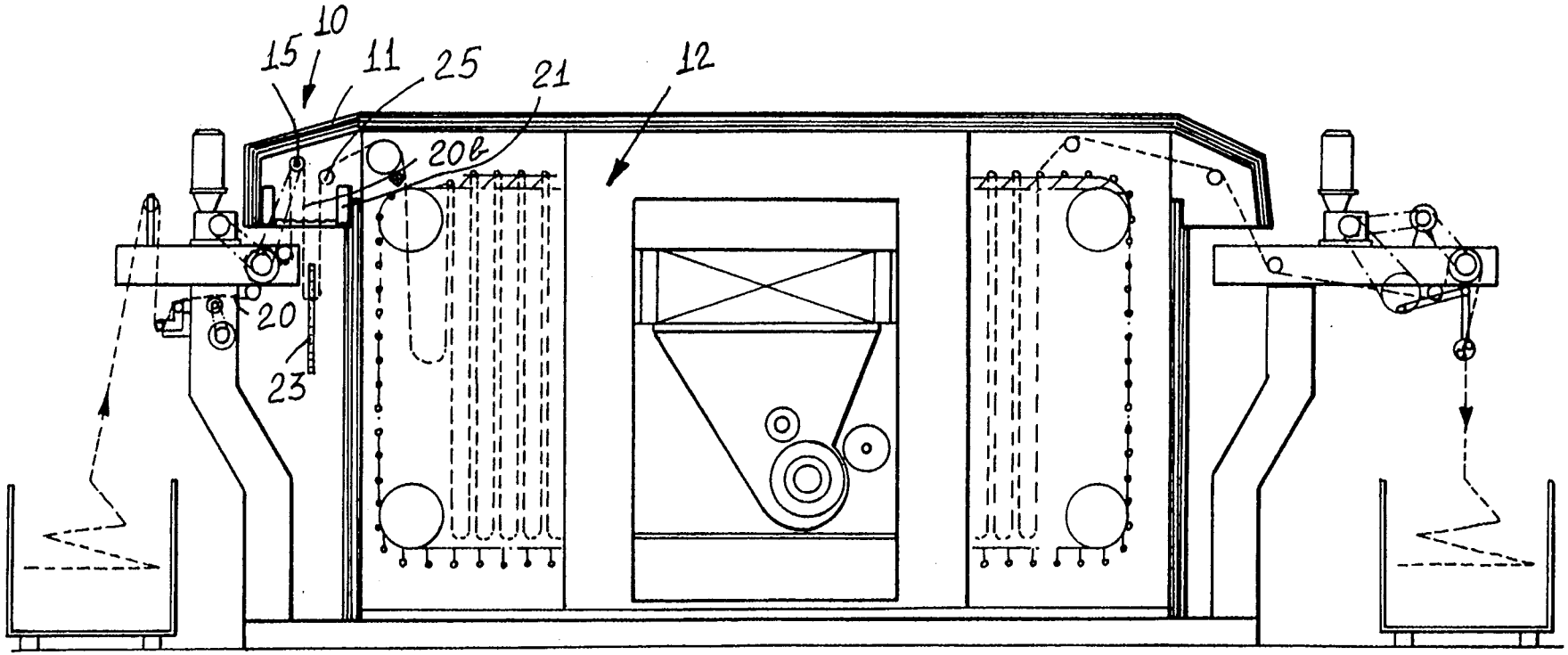
FIG. 3 illustrates the pre-moistening device applied to a steaming chamber having a closed bottom.
Figure 4:
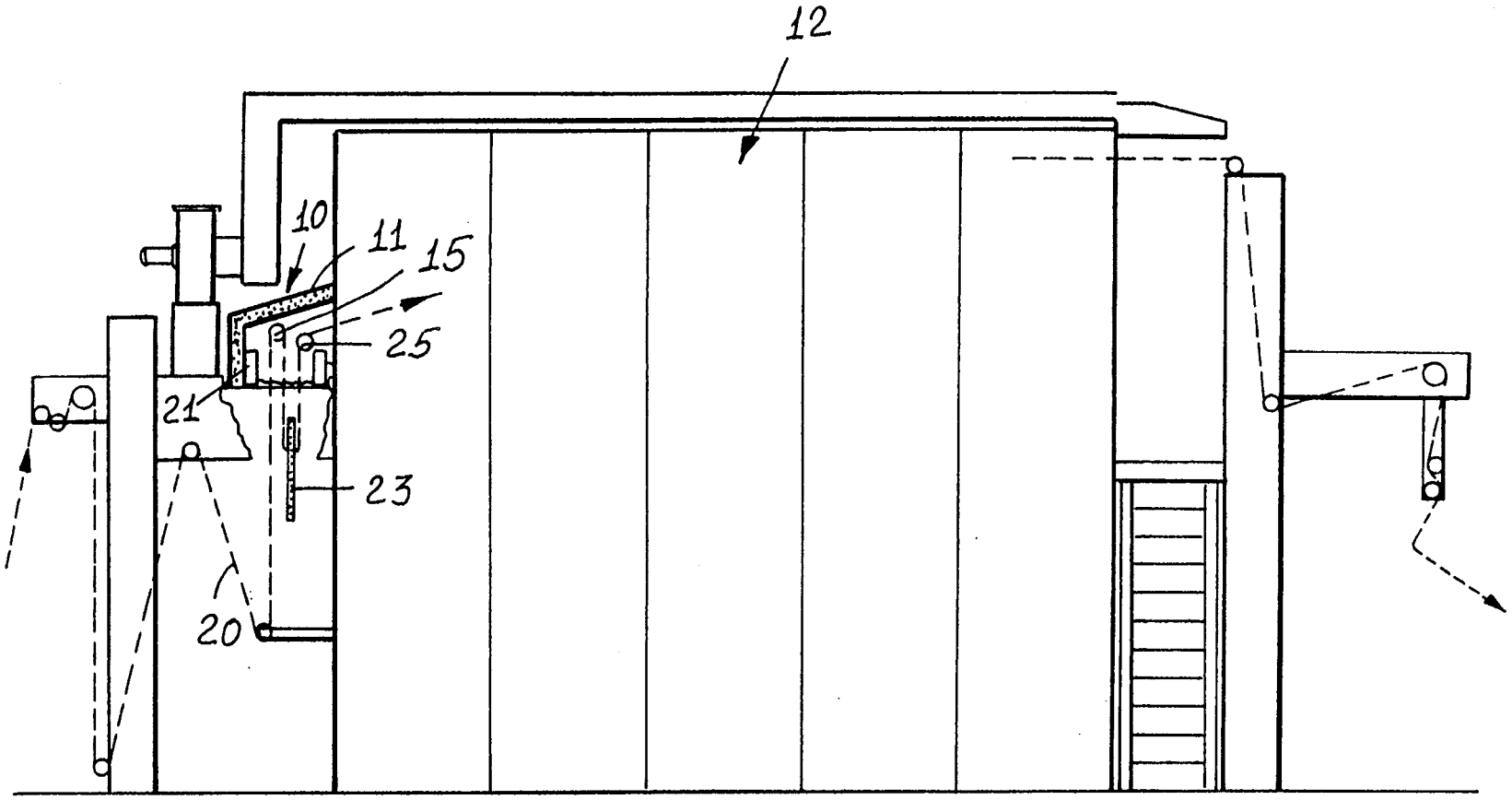
FIG. 4 illustrates the pre-moistening device applied to a steaming chamber of a commercially available type.

With reference to the FIGS. 1 to 4 and, more specifically, to FIG. 1, the device for reducing the consume of urea and/or hygroscopic chemical substances in paste materials for printing cotton and viscose fabrics, according to the present invention, comprises a pre-moistening device, generally indicated by the reference numeral 10, including a hood framework 11, provided to be affixed at the inlet of a steaming chamber, indicated by the reference numeral 12.

More specifically the hood framework 11 communicates with the steaming chamber 12, thereby steam will be directly supplied by this chamber.

Inside the hood framework 11, to which steam is supplied, there is provided at least a roller 15, for spreading the printed fabric material, indicated by the reference numeral 20, and on which the fabric material is entrained, with an upward length 20*a*, inside the pre-moistening chamber, and a subsequent downwardly directed length 20*b* exiting the pre-moistening chamber, so that the fabric material will be subjected to a steaming step for a preset time, followed by a further step in which the fabric material is held in environment air.

The hood framework, which is opened at its bottom, is fully occupied by the saturated steam, supplied by the steaming chamber 12.

Since the steam has a density smaller than the density of air, it will tend to occupy all the pre-moistening chamber, so as to eject therefrom air present therein through the opening provided through the bottom of the pre-moistening device.

In order to prevent steam from exiting the chamber, which would cause condensation of drops, with a consequent marking of the fabric, along the long sides of the hood framework there are provided, near the bottom opening, two rectangular cross-section channels, indicated by the reference numeral 21, which are provided with slots 22 facing the inside of the pre-moistening chamber.

These channels are held under a negative pressure condition so as to continuously eject the excess steam, which would tend to exit the pre-moistening chamber.

In order to prevent drops from accidentally forming on the roof of the hood framework 11, on the roof there is installed a coil element 22, therethrough steam is caused to pass, so as to hold the hood under a heated condition.

In order to adjust the time period in which the fabric is held in environment air, there is provided a photo-cell system, indicated by the reference number 23, which is specifically designed to adjust the length of the fabric lap exiting the pre-moistening chamber and which will be successively introduced again, through a transmission roller 25, into the pre-moistening chamber, before being introduced into the steaming chamber.

With the described device, the fabric will be held in the pre-moistening chamber for a sufficient time to recover its natural moisture, lost during the previous printing process, and even to increase the amount of said mixture.

In this connection it should pointed out that the natural moisture of a viscose material is 12–13%, whereas, by using saturated steam, it is possible to obtain a moisture contents of 14–16%.

After having passed through the steam of the pre-moistening device, the fabric is removed from the hood framework and then it will follow its path through environment air, for a preset time period, during which the fabric will be cooled down.

As the fabric is introduced again into the pre-moistening chamber, a further amount of steam, by condensing, will release its latent vaporizing or steaming heat, so as to increase the moisture contents of the fabric.

Immediately after, the fabric can be introduced into a conventional steaming chamber, where it will be started the process for setting the dye material to the fabric fibres, so as to allow the possibility of using reduced amounts of urea and/or hygroscopic chemical substances.

The description hereinabove comprises a pre-moistening device which is provided for a direct connection to a steaming chamber and which, accordingly, will receive steam directly from the steaming chamber.

As is shown in FIGS. 5 to 8, the pre-moistening device can comprise a pre-moistening chamber 30, independent from the steaming chamber, and including a framework 31, open at the bottom thereof, with a steam source 32 and a suction unit 33.

Moreover, on the top of this chamber, under the channel 34 conveying the steam inside said chamber, a heating coil 35 can be provided.

Also in this case, the fabric, still indicated at the reference numeral 20, will be supplied in a lap configuration, with length thereof conveyed inside the pre-moistening chamber, followed by a path through environment air, so as to provide a proper cooling of the fabric, and facilitate the condensation of the steam as the fabric is introduced again into a steam environment.

Figure 6:
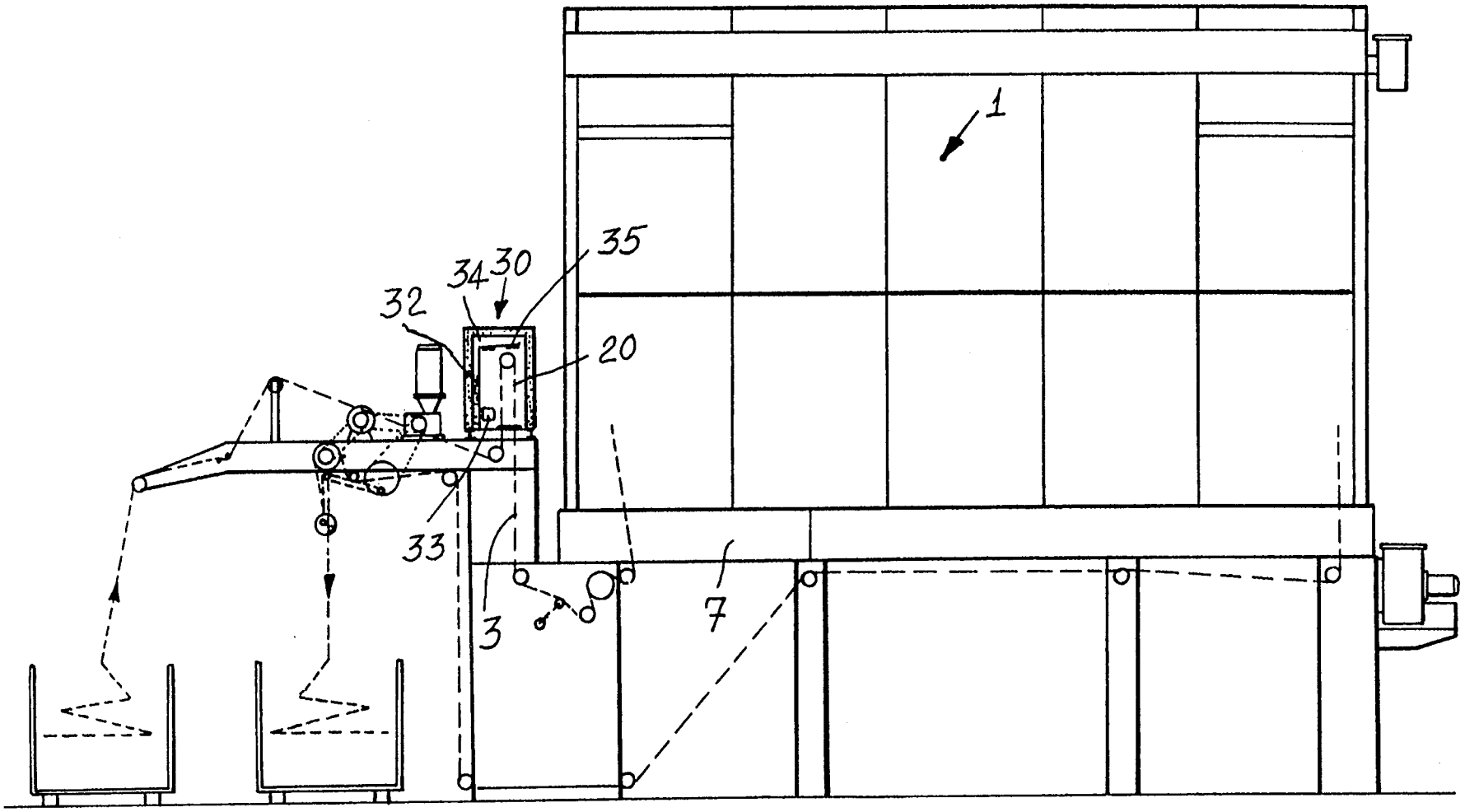
FIGS. 6, 7 and 8 illustrate the pre-moistening chamber connected to several different steaming chambers.
Figure 7:
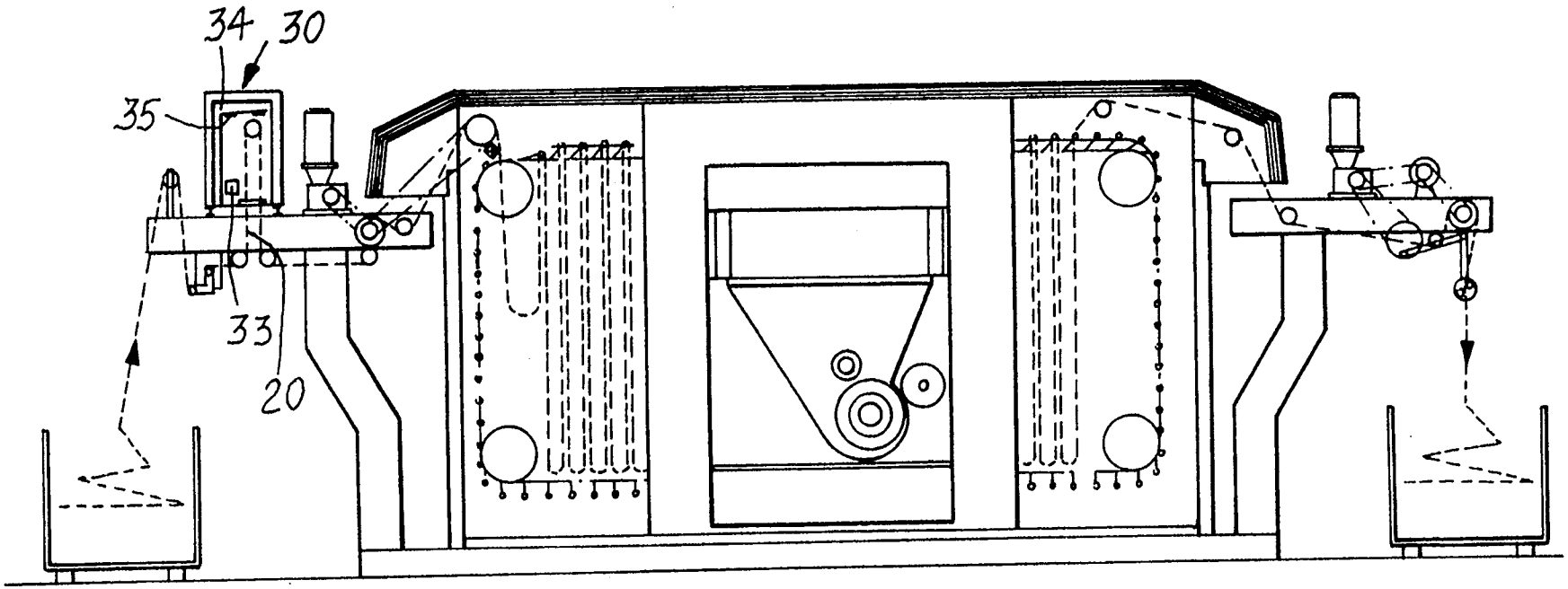
Figure 8:
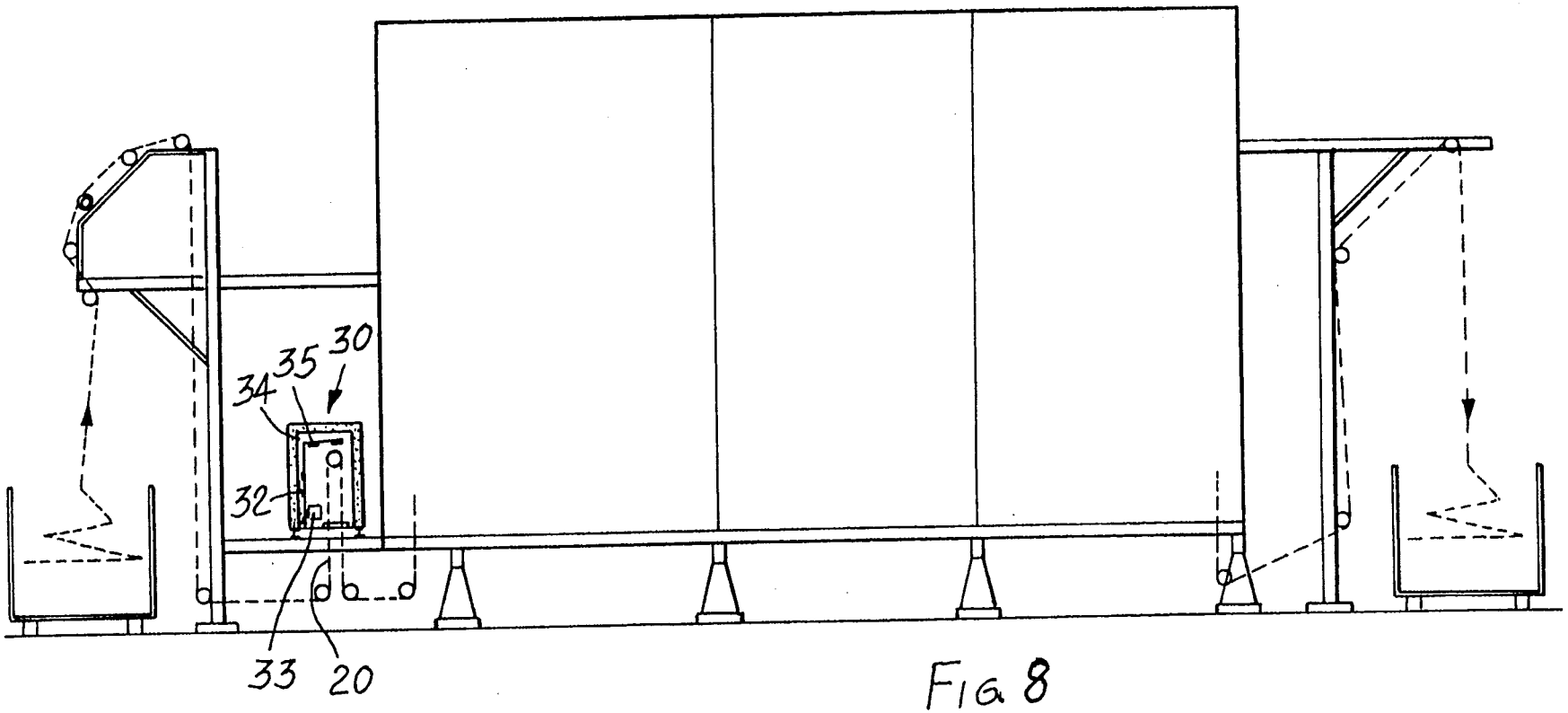

The pre-moistening chamber 30 can also be applied to commercially available steaming chambers, as it is schematically shown in FIGS. 6, 7 and 8.

Thus, a method is provided comprising the steps of introducing the printed fabric into a steam environment, cooling the steamed fabric and introducing again said steamed fabric into the steam environment, so as to increase the amount of moisture being condensed on the fabric, and facilitate the subsequent step of setting the dye in the steaming chamber, and so as to greatly reduce the amount of used urea and/or hygroscopic chemical substances.

It is also possible to provide a further embodiment for the pre-moistening device using steam as a moistening medium.

In this case, the apparatus comprises either one or more perforated lance elements, designed to inject steam on the fabric, in a continuous and even manner, before supplying the fabric into the steaming chamber.

Even in this case, between the injection point of the steam supplied by the lance elements and the inlet to the steaming chamber, there is provided, for the fabric, a path through environment air, and this for the same reasons which have been broadly above disclosed.

Accordingly, in operation, also this device will carry out a method comprising the steps of causing the printed fabric to contact steam, cooling the fabric and introducing again said cooled fabric into a steam environment, so as to increase the amount of moisture being condensed on the fabric, so as to facilitate the subsequent step of setting the dye in the steaming chamber and so as to greatly reduce the amount of used urea and/or hygroscopic chemical substances.

From the above disclosure it should be apparent that the invention fully achieves the intended objects.

In particular, the fact is to be pointed out that, by using a pre-moistening device or chamber, before the inlet of the printed fabric to the steaming chamber, it is possible to pre-moisten the fabric in a very even manner both in its cross and its longitudinal direction, thereby obviating all of the drawbacks associated with sprays of atomized water.

The invention as disclosed is susceptible to several variations and modifications all of which will come within the scope of the inventive idea.

Moreover, all of the details can be replaced by other technicall equivalent elements.

In practicing the invention, and as has been broadly disclosed, the used materials, provided that they are compatible for the intended use, as well as the shape and size can be varied, according to requirements.

I claim:

1. In the process of printing cotton and viscose fabrics which contain cellulose fibers, wherein the fabric after having been printed, is exposed to steam to set the printed pattern and at least one of urea or a hygroscopic material is added to said steam to cause said cellulose fibers to swell and to increase the moisture content of said printed fabrics, the improvement which comprises premoistening said fabric after it has been printed and prior to exposing said printed fabric to steam, by exposing said printed fabric to saturated steam in a premoistening chamber, then cooling such fabric, then exposing again said printed fabric to steam in said premoistening chamber.

2. The process as to claim 1 wherein a dye is applied to said fabric during said printing process.

* * * * *